US008727485B2

(12) United States Patent
Ahl et al.

(10) Patent No.: US 8,727,485 B2
(45) Date of Patent: May 20, 2014

(54) THREE POSITION PRINTHEAD WIPER ASSEMBLY

(75) Inventors: David K. Ahl, Rochester, NY (US); Paul A. Hosier, Rochester, NY (US); James E. Williams, Penfield, NY (US); Roger G. Leighton, Hilton, NY (US); John R. Uchal, Webster, NY (US); David P. Lomenzo, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 7 days.

(21) Appl. No.: 13/471,021

(22) Filed: May 14, 2012

(65) Prior Publication Data

US 2013/0300800 A1 Nov. 14, 2013

(51) Int. Cl.
*B41J 2/165* (2006.01)

(52) U.S. Cl.
USPC ..... 347/32

(58) Field of Classification Search
None
See application file for complete search history.

(56) References Cited

U.S. PATENT DOCUMENTS

| | | | | |
|---|---|---|---|---|
| 4,623,897 | A | 11/1986 | Brown et al. | |
| 4,676,447 | A * | 6/1987 | Zald et al. | 242/420.3 |
| 4,928,114 | A | 5/1990 | Fagerquist et al. | |
| 5,184,147 | A | 2/1993 | MacLane et al. | |
| 5,557,306 | A | 9/1996 | Fukushima et al. | |
| 5,914,735 | A | 6/1999 | Yamamoto et al. | |
| 5,949,448 | A | 9/1999 | Man et al. | |
| 6,017,110 | A | 1/2000 | Jackson | |
| 6,145,958 | A | 11/2000 | Medin et al. | |
| 6,244,683 | B1 | 6/2001 | Alvarez et al. | |
| 6,463,674 | B1 | 10/2002 | Meyers et al. | |
| 6,644,775 | B2 | 11/2003 | Murcia et al. | |
| 6,890,053 | B2 | 5/2005 | Myhill et al. | |
| 7,390,074 | B2 * | 6/2008 | Matsuba et al. | 347/22 |
| 7,455,387 | B2 | 11/2008 | Cunnington et al. | |
| 7,751,767 | B2 | 7/2010 | Burton et al. | |
| 7,901,035 | B2 | 3/2011 | Koehler et al. | |
| 7,918,530 | B2 | 4/2011 | Kanfoush et al. | |
| 8,070,277 | B2 | 12/2011 | Phillips et al. | |
| 2001/0012027 | A1 | 8/2001 | Murcia et al. | |
| 2001/0020963 | A1 * | 9/2001 | Fukushima et al. | 347/33 |
| 2007/0076048 | A1 | 4/2007 | Cunnington et al. | |
| 2008/0063441 | A1 | 3/2008 | Burton et al. | |
| 2009/0102906 | A1 | 4/2009 | Phillips et al. | |
| 2010/0220145 | A1 | 9/2010 | Koehler et al. | |
| 2010/0238227 | A1 | 9/2010 | Nystrom et al. | |
| 2011/0157278 | A1 | 6/2011 | Gulvin et al. | |
| 2011/0261110 | A1 | 10/2011 | Lu et al. | |
| 2011/0304674 | A1 | 12/2011 | Sambhy et al. | |

* cited by examiner

*Primary Examiner* — Alejandro Valencia
(74) *Attorney, Agent, or Firm* — Maginot Moore & Beck, LLP

(57) ABSTRACT

A printhead wiper assembly includes an elongated member having a first and second wiper, a linkage, and an actuator. The linkage includes a clutch that enables the elongated member to move to a plurality of positions in response to the actuator activating a plurality of times. The sequence of positions enables first wiper and then the other wiper to contact the printhead face to remove purged ink from the face.

4 Claims, 8 Drawing Sheets

THREE POSITION PRINTHEAD WIPER ASSEMBLY

TECHNICAL FIELD

This disclosure relates generally to imaging devices that eject ink from printheads to produce ink images on print media, and, more particularly, to imaging devices that clean ink from printheads in the device.

BACKGROUND

In general, inkjet printers include at least one printhead that ejects drops of liquid ink directly onto recording media or onto a surface of an intermediate image receiving member for transfer to recording media. The intermediate image receiving member in an indirect inkjet printer can be a rotating metal drum or endless belt. In a direct printer, the recording media can be in sheet or continuous web form. A phase change inkjet printer employs phase change inks that are solid at ambient temperature, but transition to a liquid phase at an elevated temperature. Once the melted ink is ejected onto recording media or the surface of an intermediate image receiving member, depending upon the type of printer, the ink droplets quickly solidify to form an ink image.

Printers typically conduct various maintenance operations to ensure proper operation of the inkjets in each printhead. One known maintenance operation removes particles or other contaminants that may interfere with printing operations from each printhead in a printer. During such a cleaning maintenance operation, the printheads purge ink through some or all of the inkjets in the printhead. The purged ink flows from the apertures of the inkjets that are located in a faceplate of each printhead onto the faceplate. The ink rolls downwardly under the effect of gravity to an ink drip bib mounted at the lower edge of the faceplate. The bib is configured with one or more multiple drip points where the liquid ink collects and drips into an ink receptacle. In some printers, one or more wipers are manipulated to contact the faceplate of each printhead and wipe the purged ink toward the drip bib to facilitate the collection and removal of the purged ink.

While existing cleaning processes are useful to maintain printheads, removing residual purged ink from the printhead remains a challenge. This challenge is particularly significant in phase change ink printers since the ink in these printers can solidify and adhere to structures in the printer. Specifically, surface tension may cause a small portion of the purged ink to remain in contact with the printhead or the drip bib after the maintenance process is concluded. The solidified ink may interfere with imaging operations if the solidified ink breaks free from the printhead faceplate or drip bib. The released solid ink may contact a web or other image receiving member as the image receiving member moves past printheads in the print zone. Since printheads are often positioned a short distance from the image receiving member, the solid ink may contact the faceplate of one or more printheads with possibly adverse consequences to the inkjets of one or more printheads. Thus, improved printhead cleaning is desirable.

SUMMARY

A printhead wiper assembly has been developed that enables a pair of wipers to cooperate to clean a face of a printhead. The printhead wiper assembly includes an elongated member having a first end and a second end, a first wiper being mounted to the first end and a second wiper being mounted to the second end. An actuator having an output shaft is configured to move between at least a first shaft position and a second shaft position. A linkage operatively connected to the output shaft of the actuator and to a position on the elongated member between the first and second ends is configured to move the elongated member to a plurality of positions in response to the output shaft of the actuator moving a plurality of times.

In another embodiment, a method of wiping a printhead has been developed that enables a pair of wipers to cooperate to clean a face of a printhead. The method includes: moving a printhead wiper assembly having a first wiper and a second wiper proximate to a printhead face and activating an actuator to move the first and second wipers from a first position, in which neither the first wiper nor the second wiper is in contact with the printhead face, to a second position, in which the first wiper is in contact with the printhead face and the second wiper is not in contact with the printhead face; translating the printhead wiper assembly from an initial position to a cleaning position to wipe the printhead face; activating the actuator to move the first and second wipers from the second position to a third position, in which neither the first wiper nor the second wiper is in contact with the printhead face; translating the printhead wiper assembly from the cleaning position to the initial position; activating the actuator to move the first and second wipers from the third position to a fourth position, in which the second wiper is in contact with the printhead face and the first wiper is not in contact with the printhead face; and translating the printhead wiper assembly from the initial position to the cleaning position to wipe the printhead face.

DETAILED DESCRIPTION

Figure 1:
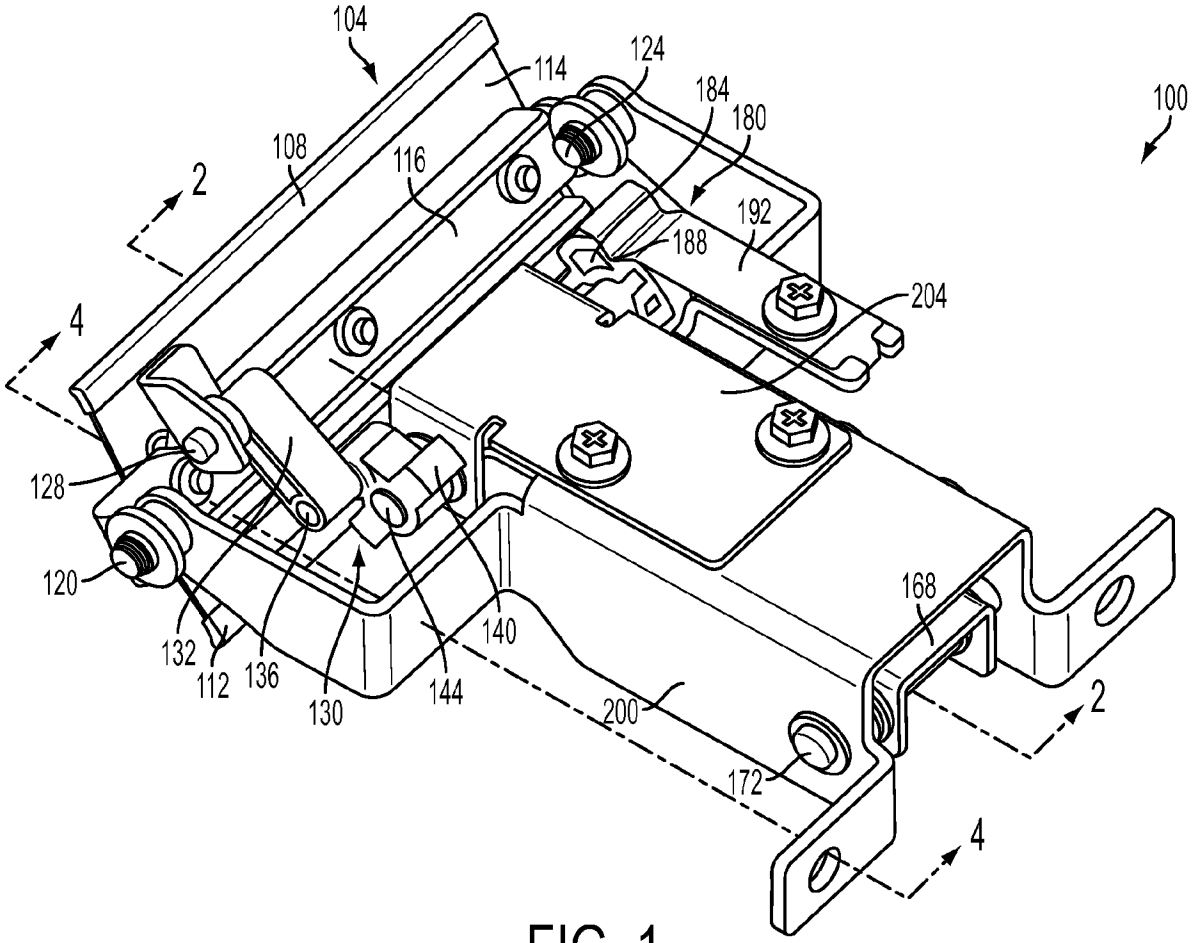
FIG. 1 is a top perspective view of a printhead wiper assembly.

For a general understanding of the present embodiments, reference is made to the drawings. In the drawings, like reference numerals have been used throughout to designate like elements. As used herein, the term "printer" generally refers to an apparatus that produces an ink image on print media and may encompass any apparatus, such as a digital copier, bookmaking machine, facsimile machine, multi-function machine, etc., which performs a printing function for any purpose.

As used in this document, "ink" refers to a colorant that is liquid when applied to a surface of an image receiving member. For example, ink may be aqueous ink, ink emulsions, solvent based inks, and phase change inks. Phase changes inks are inks that are in a solid or gelatinous state at room temperature and change to a liquid state when heated to an operating temperature for application or ejection onto an image receiving member. The phase change inks return to a solid or gelatinous state when cooled on print media after the printing process. An "image receiving member" refers to any structure onto which ink can be ejected to form an ink image. "Print media" can be a physical sheet of paper, plastic, or other suitable physical substrate suitable for receiving ink images, whether precut or web fed, while "an intermediate imaging member" is a rotating structure on which ink images are formed for transfer to print media.

As used herein, the term "direct printer" refers to a printer that ejects ink drops directly onto a print medium to form the ink images. As used herein, the term "indirect printer" refers to a printer having an intermediate image receiving member, which receives ink drops that form an ink image that is transferred to print media. A printer may include a variety of other components, such as finishers, paper feeders, and the like, and may be embodied as a copier, printer, or a multifunction machine. Image data generally includes information in electronic form that is rendered by a marking engine and used by a controller to generate firing signals to operate inkjet actuators to form text, graphics, pictures, and the like, in ink images.

The term "printhead" as used herein refers to a component in the printer that is configured with inkjet ejectors to eject ink drops to form ink images. A typical printhead includes a plurality of inkjets that are configured to eject ink drops of one or more ink colors. The inkjets are arranged in an array of one or more rows and columns. In some embodiments, the inkjets are arranged in staggered diagonal rows across a face of the printhead. Various printer embodiments include one or more printheads, which are grouped in printhead arrays, and operated to form ink images.

FIG. 1 depicts a printhead wiper assembly 100. The printhead wiper assembly 100 includes a wiper blade assembly 104, a linkage assembly 130, an actuator 164 (FIG. 2), an assembly housing 200, and a detent mechanism 180. The wiper blade assembly 104 comprises a first wiper blade 108, a second wiper blade 112, an elongated member 114, and a wiper mount 116. The elongated member 114 includes a first end, on which the first wiper blade 108 is mounted, and a second end, on which the second wiper blade 112 is mounted. The elongated member 114 is affixed to the wiper mount 116, which connects to the assembly housing 200 by pivot pins 120, 124, enabling the wiper blade assembly 104 to pivot about the pivot pins 120, 124. A wiper mount pin 128 connects the wiper mount 116 to the linkage assembly 130.

Figure 2:
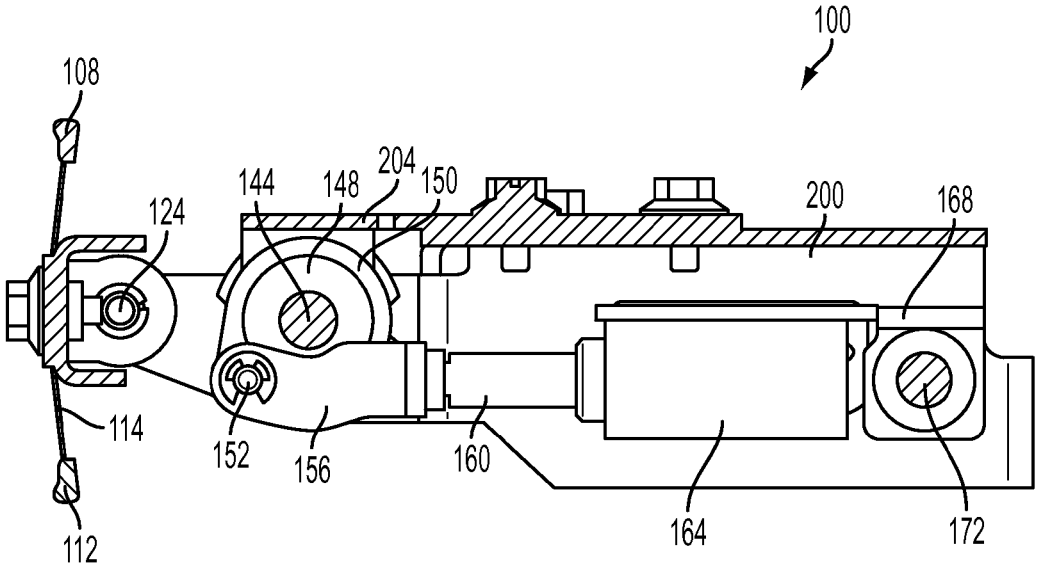
FIG. 2 is a cross-sectional view of the printhead wiper assembly of FIG. 1 taken along line 2-2 of FIG. 1.

The linkage assembly 130 includes a linkage member 132, a rotating member 140, a rotating shaft 144, a one way clutch 148 (FIG. 2), and a cam 150 (FIG. 2). The linkage member 132 connects to the wiper mount pin 128 and is configured to enable the linkage member 132 to control the pivoting of the wiper mount 116 about the pivot pins 120, 124. The linkage member 132 connects to the rotating member 140 by a linkage pin 136, enabling the linkage member 132 to pivot about the linkage pin 136. The rotating member 140 is fixedly mounted to the shaft 144 to enable the rotating member 140 to rotate with the shaft in response to the shaft 144 rotating. The one way clutch 148 is operatively connected to the rotating shaft 144 and the cam 150, which is connected to the actuator 164. The cam 150 is mounted for rotation about rotating shaft 144. The one way clutch 148 is configured to transmit only counterclockwise rotation of the cam 150 to the rotating shaft 144 to enable the cam 150 to rotate in the clockwise direction without turning the rotating shaft. Thus, the one way clutch 148 enables the rotating shaft 144 to rotate only in the counterclockwise direction and the cam 150 in both the clockwise and counterclockwise directions to transfer linear movement of the actuator 164 to rotational movement of the cam 150 and the shaft 144.

Figure 3:
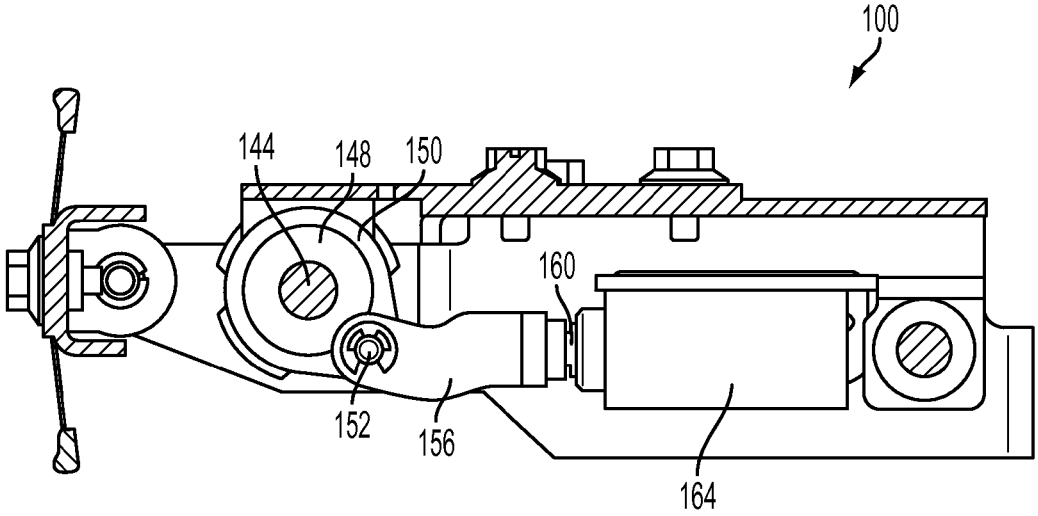
FIG. 3 is a cross-sectional view of the printhead wiper assembly of FIG. 1 taken along line 2-2 of FIG. 1, showing an output shaft retracted.

With reference to FIG. 2 and FIG. 3, the actuator 164 includes an actuator output shaft 160 and a connecting arm 156. The cam 150 is connected to the connecting arm 156 by a cam pin 152. The connecting arm 156 is attached to the actuator output shaft 160, which is configured to retract into the actuator 164 when the actuator 164 is activated, as shown in FIG. 3. In one embodiment the actuator 164 is a pneumatic piston, although different actuators are used in other embodiments. The actuator 164 is mounted in the housing 200 by an actuator mount 168, which is affixed to the housing 200 by an actuator mounting pin 172.

The detent mechanism 180 includes a detent wheel 184 having four detent stops 188 and a detent member 192. The detent wheel 184 is fixedly mounted to the rotating shaft 144 to enable the detent wheel to rotate with the rotating shaft 144. The detent member 192 is affixed at a first end to the assembly housing 200 and a second end of the detent member 192 is configured to rest in one of the four detent stops 188 when the actuator 164 is not cycling. The detent member 192 is configured to exert a downward force on the detent stop 188, disabling movement of the detent wheel 184 and rotating shaft 144 when the actuator 164 is not activated.

The printhead wiper assembly 100 is located within a printer, and operates to clean a printhead 240 after a purge cycle. Each printhead 240 includes a printhead face 244, which includes an array of apertures to which inkjet ejectors are fluidly coupled for the ejection of ink drops onto an image receiving surface, and may include a drip bib 248 designed to direct excess ink from the printhead face 244 to a collection container (not shown).

Figure 4:
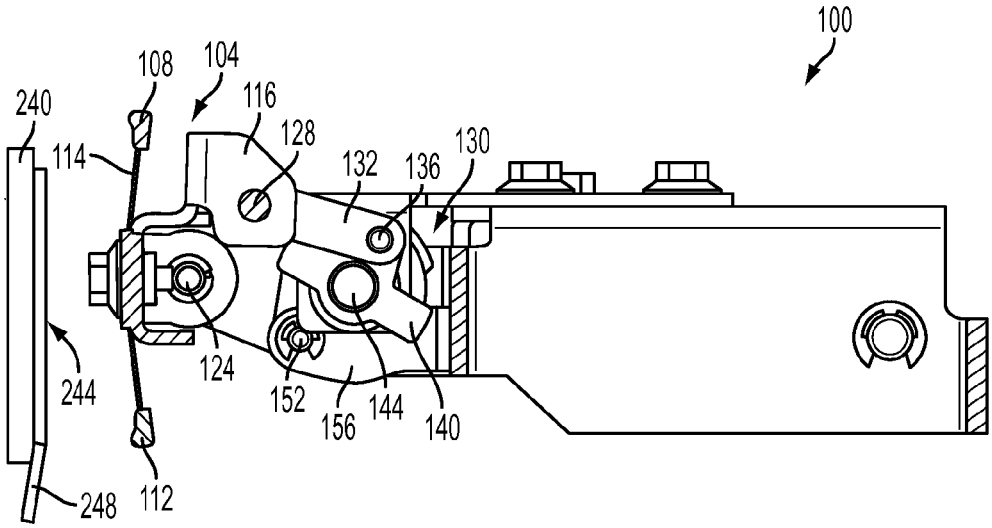
FIG. 4 is a cross-sectional view of the printhead wiper assembly of FIG. 1 taken along line 4-4 of FIG. 1, showing an elongated member in a first position.
Figure 5:
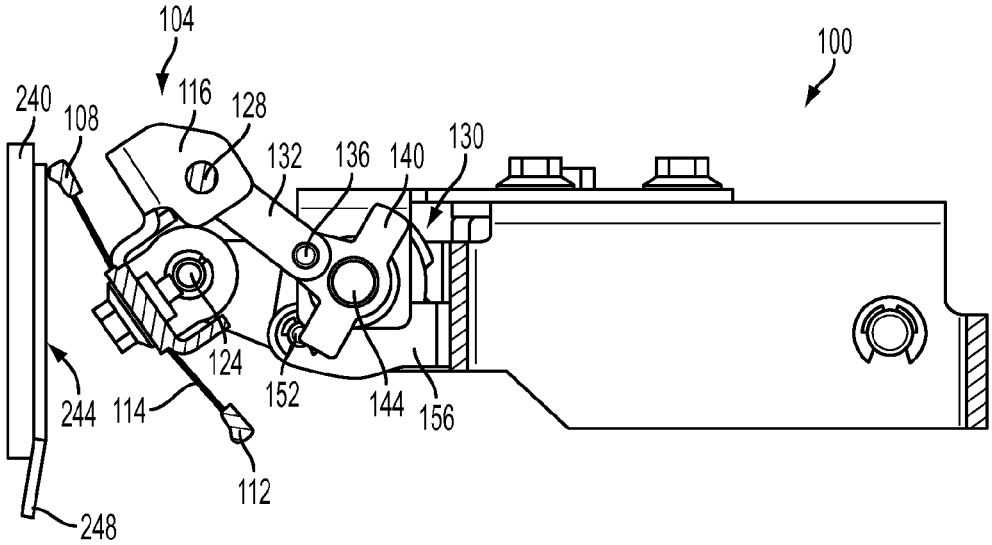
FIG. 5 is a cross-sectional view of the printhead wiper assembly of FIG. 1 taken along line 4-4 of FIG. 1, showing the elongated member in a second position.

When the printer initiates a purge sequence, ink is released from the inkjets under relatively low pressure so it flows down the printhead face 244. Printhead wiper assembly 100 is moved proximate to the printhead, as shown in FIG. 4, where the elongated member 114 is in a first position, and a wiping cycle is initiated. The actuator 164 cycles, moving the output shaft 160 from the first shaft position, shown in FIG. 2, to the second shaft position, shown in FIG. 3, and then back to the first shaft position. The first phase of the cycle, moving the actuator output shaft 160 from the first shaft position to the second shaft position, retracts the output shaft 160 into the actuator 164, pulling the connector arm 156 toward the actuator 164. The cam 150 and one way clutch 148 rotate counter-clockwise one quarter turn in response to the connector arm 156 moving. Rotation of the one way clutch 148 turns the rotating shaft 144, rotating member 140, and detent wheel 184 with sufficient force to overcome the force that the detent member 192 exerts on the detent wheel 184, turning the rotating member 140, shaft 144, and detent wheel 184 counter-clockwise one quarter turn, to the position shown in FIG. 5. The linkage pin 136 is moved by the rotating member 140 to push the linkage member 132 and rotate the wiper blade assembly 104 counter-clockwise about the pivot pins 120, 124 until the first wiper blade 108 engages the printhead face 244. The detent member 192 engages a second detent stop on the detent wheel 184, holding the wiper blade assembly 104 and elongated member 114 in a second position, as shown in FIG. 5.

The actuator 164 completes a cycle by returning the output shaft 160, connecting arm 156, cam 150, and one way clutch 148 to the first shaft position. The one way clutch 148 slips to prevent transfer of clockwise movement of the cam 150 to the rotating shaft 144. Thus, while the cam 150 and one way clutch 148 return to the initial position, the rotating shaft 144, rotating member 140, linkage member 132, and wiper blade assembly 104 remain in the second position.

A motor (not shown) then translates the printhead wiper assembly 100 from an initial position downward to a cleaning position, pushing any ink remaining on the printhead face 244 from the ink purge toward the drip bib 248. In one embodiment the printhead wiper assembly 100 translates approximately 30 millimeters, although the amount of the translation varies in other embodiments depending on the size of the printhead 240 and amount of space available near the printhead 240.

Figure 6:
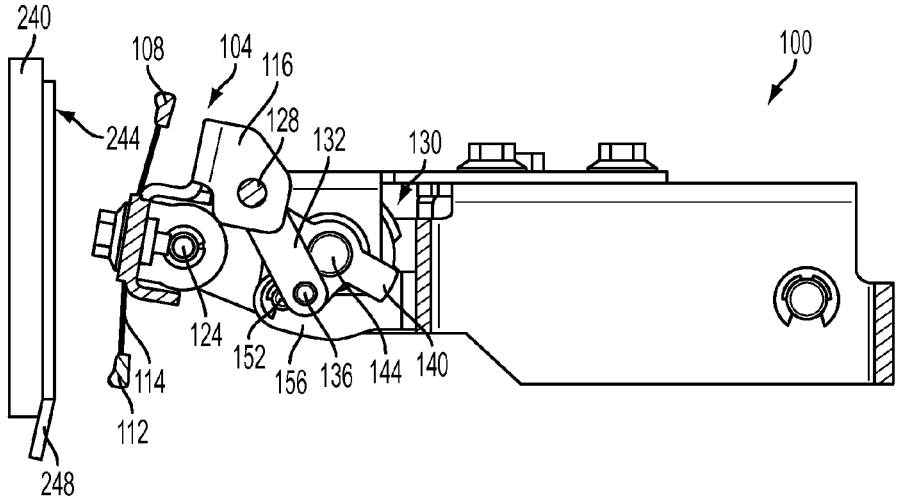
FIG. 6 is a cross-sectional view of the printhead wiper assembly of FIG. 1 taken along line 4-4 of FIG. 1, showing the elongated member in a third position.

While the printhead wiper assembly 100 is in the cleaning position, the actuator 164 cycles again, rotating the cam 150, clutch 148, shaft 144, rotating member 140, and detent wheel 184 counter-clockwise another one quarter turn, where the detent member 192 rests in a third detent stop. This counter-clockwise rotation moves the linkage pin 136 downwardly to pull the linkage arm 132 and the wiper blade assembly 104 to enable the assembly to pivot clockwise about the pivot pins 120, 124 to a third position, as shown in FIG. 6, wherein neither of the wiper blades 108, 112 are in contact with the printhead face 244.

Figure 7:
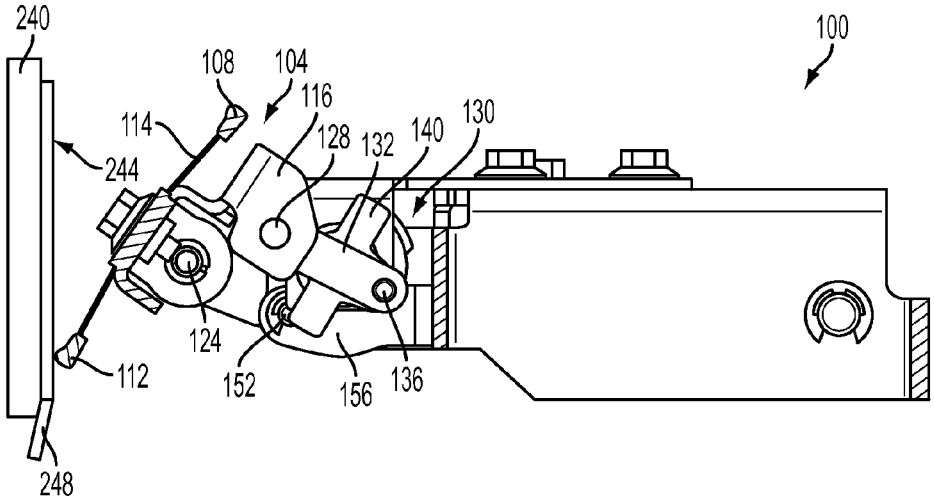
FIG. 7 is a cross-sectional view of the printhead wiper assembly of FIG. 1 taken along line 4-4 of FIG. 1, showing the elongated member in a fourth position.

The printhead wiper assembly 100 is then translated back to the initial position. The actuator 164 cycles again, moving rotating shaft 144, rotating member 140, linkage member 132, and elongated member 114 to a fourth position, as shown in FIG. 7. In the fourth position, the second wiper blade 112 is in contact with the printhead face 244. The printhead wiper assembly 100 is translated to the cleaning position to urge the ink on the bottom portion of the printhead face 244 and drip bib 248 down and away from the printhead 240. The actuator 164 then cycles again, returning the wiper blade assembly 104, linkage member 132, rotating member 140, shaft 144, and detent wheel 184 to the first position shown in FIG. 4. The printhead wiper assembly 100 is translated back to the initial position, completing the wiping cycle.

In operation, a printer in which the wiper blade assembly described above is installed initiates a purge cycle at specified intervals or upon detection of a specified number of malfunctioning inkjets. Upon initiating the purge, the ink reservoir within a printhead is pressurized to force ink through the inkjet ejectors of the printhead and emit a quantity of ink through the nozzles in the face 244 to clear debris from the ejectors and printhead face. The majority of the purged ink flows slowly down the printhead face 244, onto the drip bib 248, and into a collection container (not shown) for disposal or recycling. However, a portion of the ink may remain on the printhead face 244. The printhead wiper assembly 100 is moved proximate to the printhead face 244 to initiate a wiping cycle. The controller operates the actuator as described above to move the first and second wipers through the described sequence to urge ink remaining on the top portion of the printhead face 244 down the printhead face 244 and drip bib 248 into the collection container. The printhead wiper assembly 100 is then moved away from the printhead to enable printing operations to resume.

Figure 8:
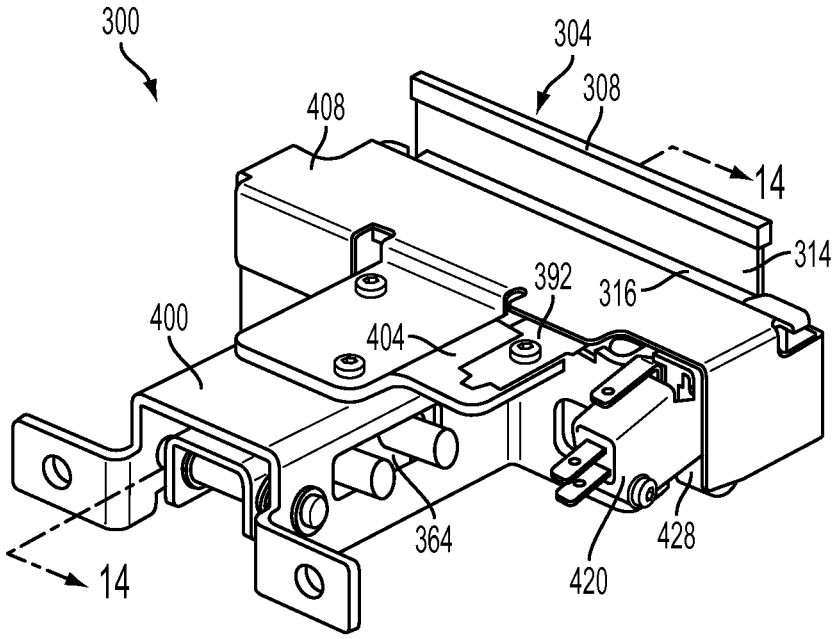
FIG. 8 is top perspective view of another printhead wiper assembly.
Figure 9:
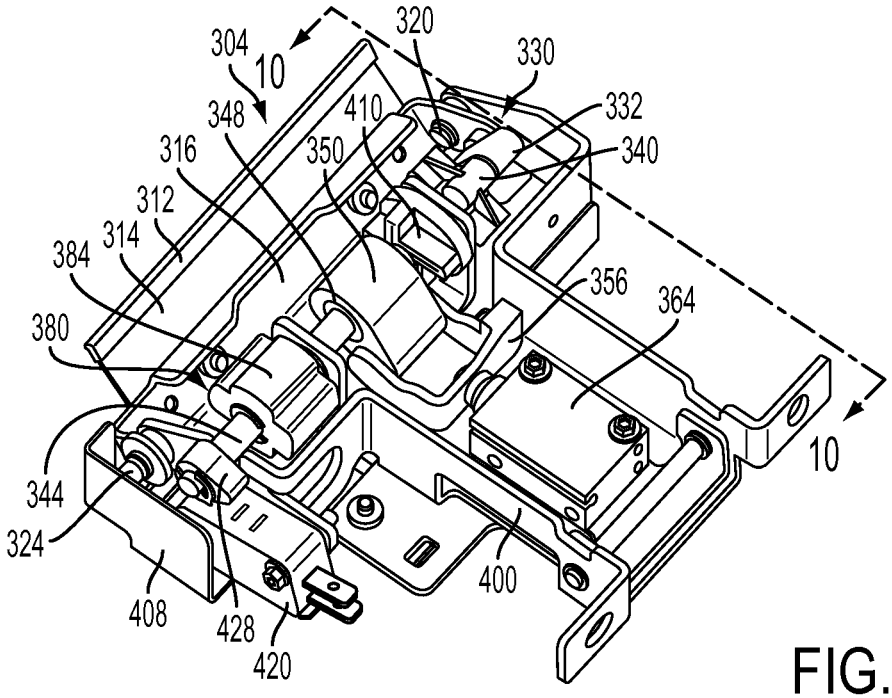
FIG. 9 is a bottom perspective view of the printhead wiper assembly of FIG. 8.

Another embodiment of a printhead wiper assembly 300 is illustrated in FIG. 8 to FIG. 15. FIG. 8 and FIG. 9 are top and bottom perspective views, respectively, of the printhead wiper assembly 300. The printhead wiper assembly 300 includes a wiper blade assembly 304, a linkage assembly 330, an actuator 364, a detent mechanism 380, a switch 420, an assembly housing 400, a clutch housing 404, and a cover 408.

The wiper blade assembly 304 has a first wiper blade 308, a second wiper blade 312, an elongated member 314, and a wiper mount 316. The elongated member 314 includes a first end, on which the first wiper blade 308 is mounted, and a second end, on which the second wiper blade 312 is mounted. The elongated member 314 is affixed to the wiper mount 316, which connects to the assembly housing 400 by pivot pins 320, 324, enabling the wiper blade assembly 304 to pivot about the pivot pins 320, 324. The wiper mount 316 is operatively connected to the linkage assembly 330, which controls the pivoting of the wiper blade assembly 304.

As shown in FIG. 9, the linkage assembly 330 includes a linkage member 332, a rotating member 340, a rotating shaft 344, a one way clutch 348, a cam 350, and a stop wheel 410. The linkage member 332 is configured to control the pivoting of the wiper mount 316 and elongated member 314 about the pivot pins 320, 324. The linkage member 332 connects to the rotating member 340 by a linkage pin 336, enabling the linkage member 332 to pivot about the linkage pin 336. The rotating member 340 is fixedly mounted to the shaft 344 to enable the rotating member 340 to rotate with the shaft 344 in response to the shaft 344 rotating. The one way clutch 348 is operatively connected to the rotating shaft 344 and the cam 350, which is connected to the actuator 364. The cam 350 is mounted for rotation about rotating shaft 344. The one way clutch 348 is configured to transmit only clockwise rotation of the cam 350 to the rotating shaft 344 to enable the cam 350 to rotate in the counterclockwise direction without turning the rotating shaft 344. Thus, the one way clutch 348 enables the rotating shaft 344 to rotate only in the clockwise direction and the cam in both the clockwise and counterclockwise directions to transfer linear movement of the actuator 364 to rotational movement of the cam 350 and the shaft 344. The stop wheel 410 is fixedly mounted on the rotating shaft 344 and configured to rotate with the rotating shaft 344.

Figure 14:
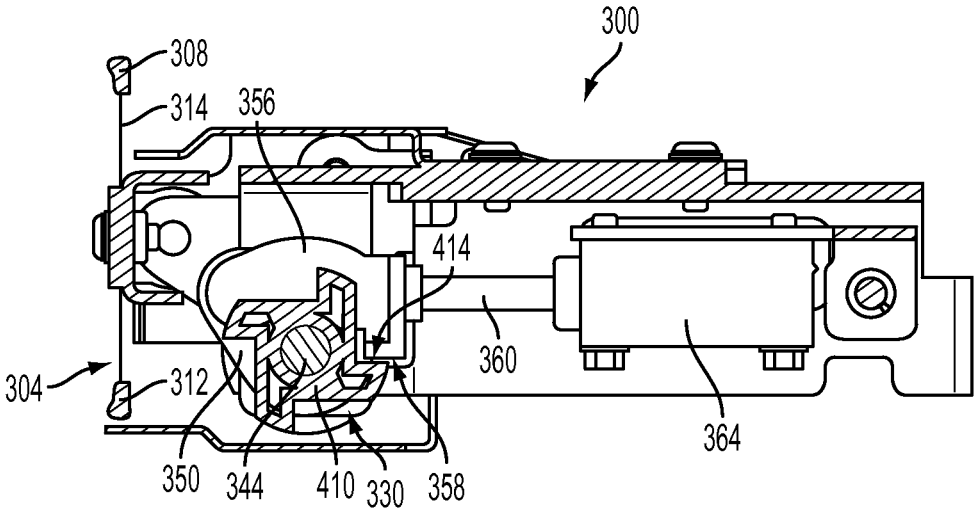
FIG. 14 is a cross-sectional view of the printhead wiper assembly of FIG. 8 taken along line 14-14 of FIG. 8.

With reference to FIG. 14, the actuator 364 includes an actuator output shaft 360 and a connecting arm 356. The cam 350 is operatively connected to the connecting arm 356, which is attached to the actuator output shaft 360. The output shaft 360 is configured to retract into the actuator 364 when the actuator 364 is activated, as shown in FIG. 9, to pull the connecting arm 356 and rotate the cam 350. The actuator 364 is fixedly mounted in the housing 400.

Figure 10:
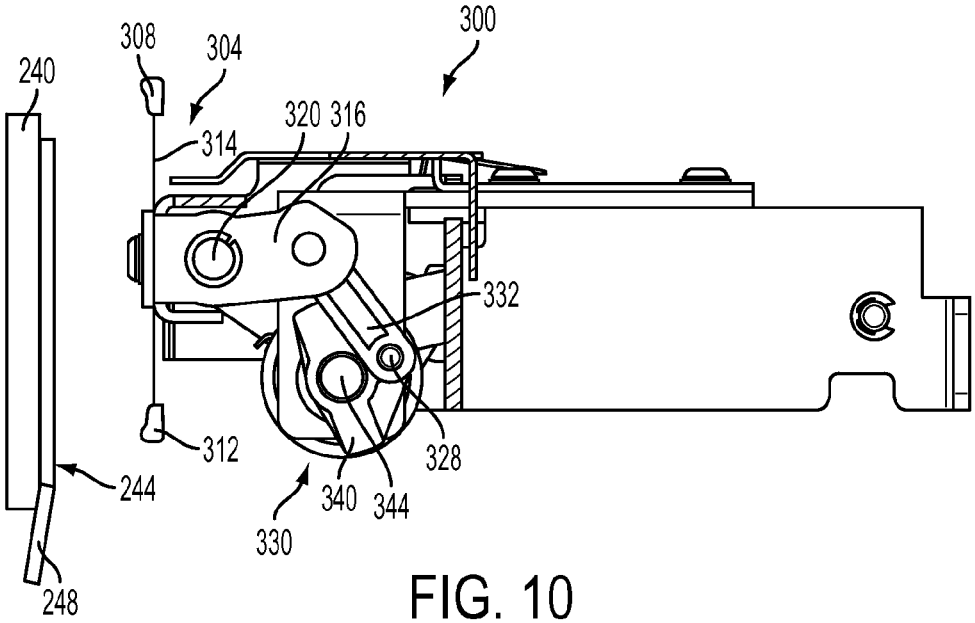
FIG. 10 is a cross-sectional view of the printhead wiper assembly of FIG. 8 taken along line 10-10 of FIG. 1, showing an elongated member in a first position.
Figure 15:
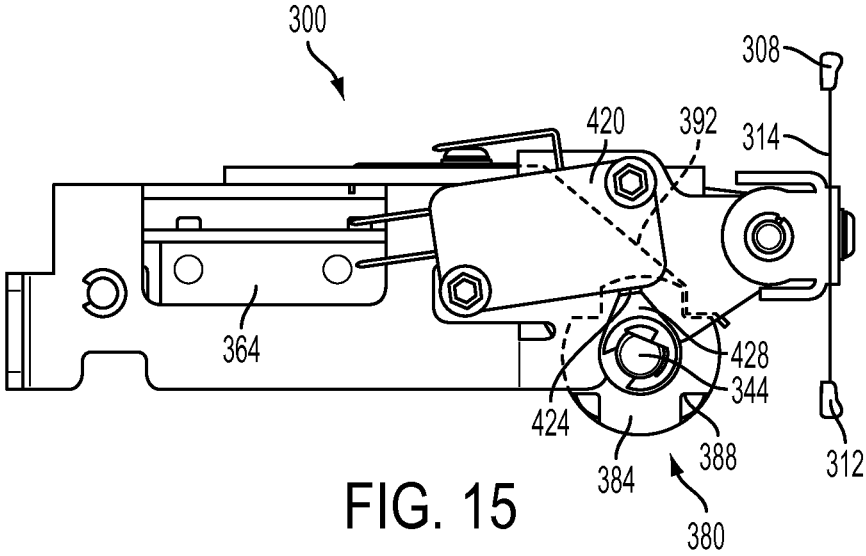
FIG. 15 is a back view of the printhead wiper assembly of FIG. 8 with the cover removed for clarity.

As shown in FIG. 15, the switch includes a switch actuator 424, configured to engage an actuator cam 428 when the printhead wiper assembly 300 is in a first position, as shown in FIG. 10 and FIG. 15. The switch actuator 424 of the illustrated embodiment is a two position button that is configured to be depressed in response to the actuator cam 428 applying pressure to the switch actuator 424. The switch 420 sends an electronic signal to the printer controller (not shown) in response to pressure being applied to the switch actuator 424, signaling the controller that the printhead wiper assembly 300 is in the first position.

In the embodiment of FIG. 15, the switch 420 is a single microswitch. In other embodiments, two or more microswitches can be used to inform the controller of the position of the printhead wiper assembly 300 at all times. The switch can also be an optical sensor configured to sense the position of the printhead wiper assembly, or one or more reed switches to signal the controller of the position of the assembly.

The detent mechanism 380 includes a detent wheel 384 having four detent stops 388 and a detent member 392. The detent wheel 384 is fixedly mounted to the rotating shaft 344 to enable the detent wheel to rotate with the rotating shaft 144. The detent member 392 is affixed at a first end to the assembly housing 400 and a second end of the detent member 392 is configured to rest in one of the four detent stops 388 when the actuator 364 is not cycling. The detent member 392 is configured to exert a force on the detent stop 388, preventing movement of the detent wheel 384 and rotating shaft 344 when the actuator 364 is not activated.

Figure 11:
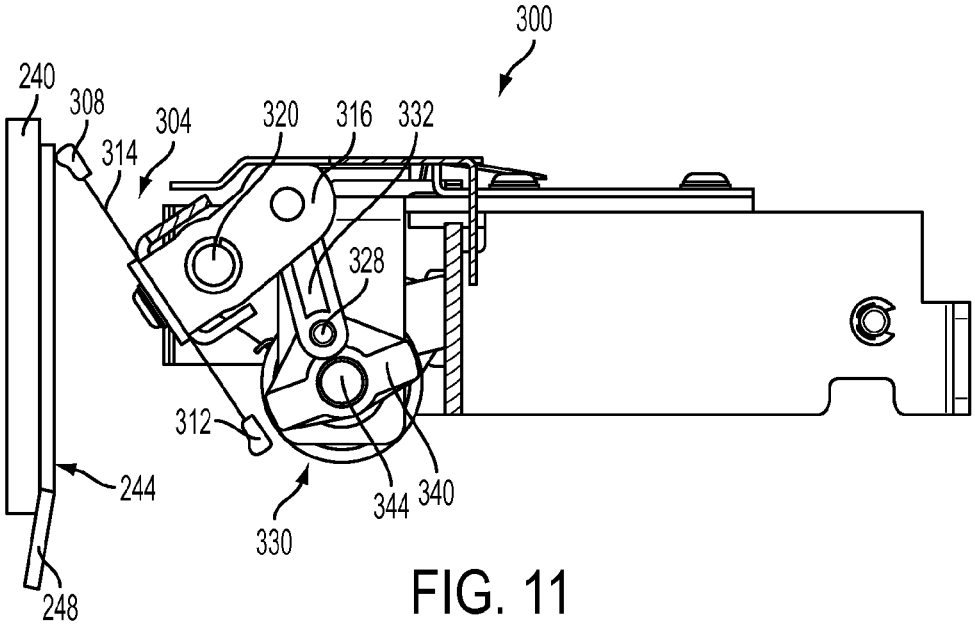
FIG. 11 is a cross-sectional view of the printhead wiper assembly of FIG. 8 taken along line 10-10 of FIG. 1, showing the elongated member in a second position.
Figure 12:
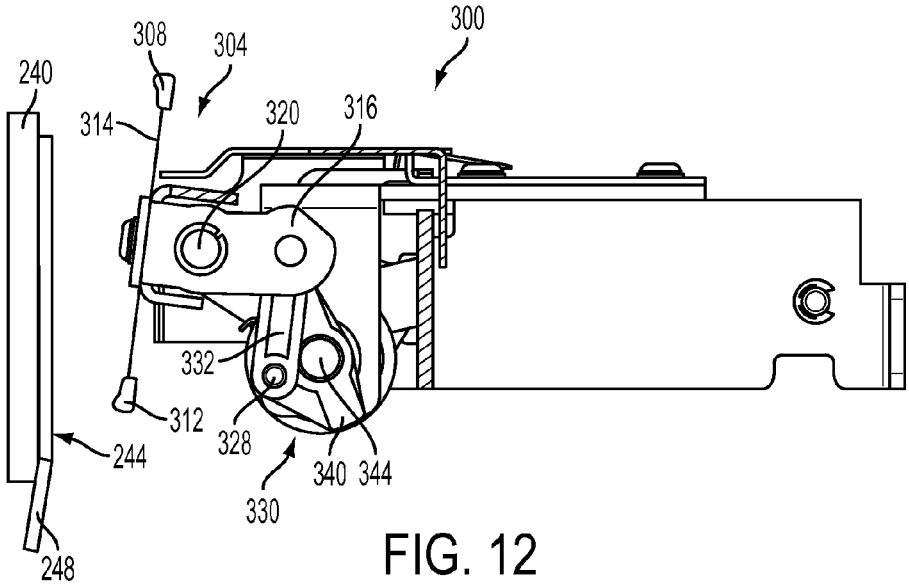
FIG. 12 is a cross-sectional view of the printhead wiper assembly of FIG. 8 taken along line 10-10 of FIG. 1, showing the elongated member in a third position.
Figure 13:
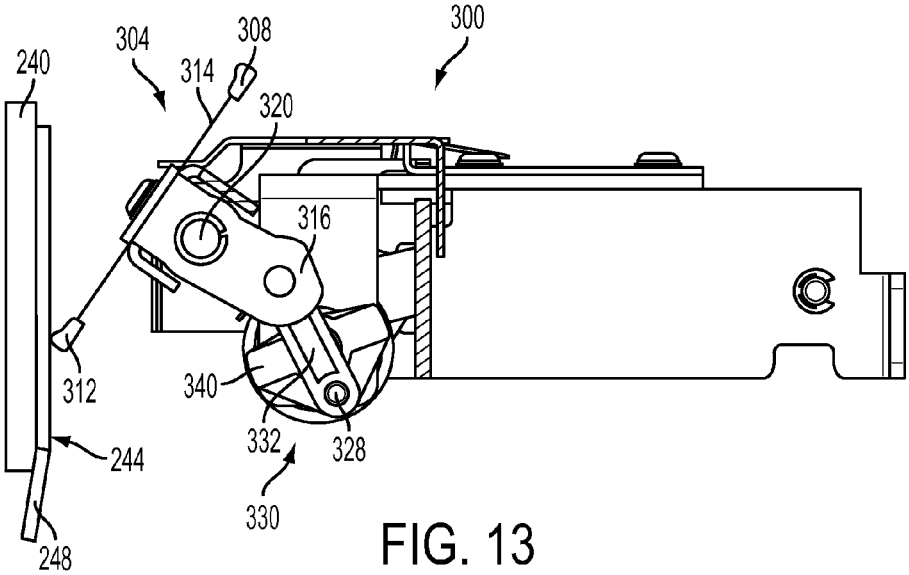
FIG. 13 is a cross-sectional view of the printhead wiper assembly of FIG. 8 taken along line 10-10 of FIG. 1, showing the elongated member in a fourth position.

FIG. 10 to FIG. 13 illustrate four positions between which the printhead wiper assembly 300 is configured to cycle. These positions are similar to the positions described above with reference to FIG. 4 to FIG. 7. After the printer initiates a purge cycle, the printhead wiper assembly 300 is moved to the first position proximate to printhead 240 to begin a wiping cycle (FIG. 10). In the first position neither of the wiper blades 308, 312 are in contact with the printhead face 244. The actuator 364 then cycles, retracting the output shaft 360 and connecting arm 356 into the actuator 364. The connecting arm 356 pulls the cam 350 toward the actuator, rotating the cam 350 and one-way clutch 348 clockwise one quarter turn. The clutch 348 transmits the clockwise movement to the rotating shaft 344, which rotates the rotating member 340 one quarter turn. The linkage member 332 pushes upwardly on the wiper blade assembly 304, pivoting the wiper blade assembly 304 about the pivot pins 320, 324 to a second position wherein the first wiper blade 308 is in contact with the face 244 of the printhead 240, as shown in FIG. 11. The detent wheel 384 rotates with the rotating shaft 344 until the detent member 392 (FIG. 15) rests in one of the detent stops 388 of the detent wheel 384, retaining the elongated member 314, wiper mount 316, linkage member 332, rotating member 340, and rotating shaft 344 in the position of FIG. 11.

The actuator extends the output shaft 360 back to the initial position, returning the connecting arm 356 and cam 350 to the initial position, as shown in FIG. 14. The one-way clutch 348 slips, preventing the rotation of the cam 350 from turning the rotating shaft 344 in the return stroke. As the connecting arm 356 returns to the initial position, a surface 358 on the connecting arm 356 engages a surface 414 on the stop wheel 410. The engagement of the surfaces 358, 414 stops any residual rotational momentum of the stop wheel 410, disabling the rotating shaft 344 from rotating more than one quarter turn with a single activation of the actuator 364 and allowing the detent member 392 to come to rest in the detent stop 388.

The printhead wiper assembly 300 then translates downwardly to wipe the upper portion of the printhead face 244 in the same manner as described above with reference to FIG. 1 through FIG. 7. The actuator 364 activates again to rotate the rotating shaft 344 and rotating member 340 clockwise another one quarter turn. In response, the linkage arm 332 pulls downwardly on the wiper mount 316, rotating the wiper blade assembly 304 clockwise about the pivot pins 320, 324 to disengage the first wiper blade 308 from the printhead face 244. The printhead wiper assembly 300 translates back to the initial position, shown in FIG. 12, wherein the printhead wiper assembly 300 is in a third position.

The actuator 364 cycles a third time to rotate the rotating shaft 344 and rotating member 340 one quarter turn clockwise and pull the linkage member 332 downward. The wiper blade assembly 304 rotates clockwise in response to the linkage member 332 being pulled downward, moving the second wiper blade 312 into contact with the printhead face 244 shown in FIG. 13, wherein the printhead wiper assembly 300 is in a fourth position. The position on the printhead face 244 contacted by the second wiper blade 312 is slightly above the lowest position on the printhead face 244 contacted by the first wiper blade 308 when the first wiper blade 308 is in the cleaning position to enable the second wiper blade 312 to wipe any residue remaining from the first wiper blade 308. In one embodiment the second wiper blade 312 contacts the printhead face 244 approximately three millimeters above the lowest position wiped by the first wiper blade 308. The printhead wiper assembly 300 then translates down to wipe the bottom portion of the printhead face 244 with the second wiper blade 312. After the lower portion is wiped, the actuator 364 activates to disengage the second wiper blade 312 from the printhead face 244 and the printhead wiper assembly 300 is translated back to the first position of FIG. 10 and FIG. 15.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A printhead wiper assembly comprising:

an elongated member having a first end and a second end, a first wiper being mounted to the first end and a second wiper being mounted to the second end;

an actuator having an output shaft that is configured to move from a first shaft position to a second shaft position and to reverse the output shaft movement to move from the second shaft position to the first shaft position;

a linking arm having a first end and a second end, the first end of the linking arm being operatively connected to the elongated member between the first and second ends of the elongated member to pivot the elongated member about a pivot pin and the second end of the linking arm being fixedly and eccentrically mounted to a shaft to enable the linking arm to rotate with the shaft, the output shaft of the actuator being eccentrically coupled to the shaft to rotate the shaft in a first rotational direction in response to the output shaft of the actuator moving from the first shaft position to the second shaft position and to maintain the shaft at a current position in response to the output shaft moving from the second shaft position to the first shaft position, the rotation of the shaft and the linking arm in the first rotational direction pivoting the elongated member about the pivot pin to move the first wiper and the second wiper through a plurality of positions in response to the output shaft of the actuator moving from the first shaft position to the second shaft position and from the second shaft position to the first shaft position a plurality of times, each movement of the actuator output shaft from the first position to the second position rotates the shaft a predetermined number of degrees in an arc to pivot the elongated member about the pivot pin to move the first wiper and the second wiper to:

a first position in which neither the first nor the second wiper is in contact with a printhead face;

a second position in which the first wiper is in contact with the printhead face and the second wiper is not in contact with the printhead face;

a third position in which neither the first wiper nor the second wiper is in contact with the printhead face; and a fourth position in which the second wiper is in contact with the printhead face and the first wiper is not in contact with the printhead face;

a cam mounted for bi-directional rotation about the shaft, the output shaft of the actuator being connected to the cam and the cam being configured to rotate the shaft in the first rotational direction in response to the output shaft of the actuator moving from the first shaft position to the second shaft position and to rotate about the shaft without the shaft rotating in the second rotational direction in response to the output shaft of the actuator moving from the second shaft position to the first shaft position to enable the first wiper and the second wiper to move to the first position, the second position, the third position, and the fourth position in sequence and then back to the first position;

a one way clutch mounted about the shaft and in contact with the cam to enable the cam to rotate the shaft in the first rotational direction in response to the output shaft of the actuator moving from the first shaft position to the second shaft position and to rotate about the shaft without the shaft rotating in the second rotational direction in response to the output shaft of the actuator moving from the second shaft position to the first shaft position to enable the first wiper and the second wiper to move through the first position, the second position, the third position, and the fourth position in sequence; and a detent mechanism configured to block the shaft from rotating in the second rotation direction, the detent mechanism having a detent wheel and a detent member, the detent wheel being fixedly mounted about the shaft and the detent wheel having a plurality of detent stops, the detent member being configured with a first end and a second end, the first end of the detent member being fixedly mounted and the second end of the detent member being configured to engage the detent stops in the detent wheel as the shaft and the detent wheel rotate in the first rotational direction to stop further rotation of the shaft in the first rotational direction until a next move of the output shaft of the actuator from the first shaft position to the second shaft position.

2. The printhead wiper assembly of claim 1, the actuator being configured to move the output shaft in a linear manner between the first shaft position and the second shaft position.

3. The printhead wiper assembly of claim 1, the printhead wiper assembly being configured to translate in a direction parallel to the printhead face to wipe the printhead face with one of the first wiper and the second wiper.

4. The printhead wiper assembly of claim 1 further comprising:

a switch configured to detect the first wiper and the second wiper being in one of the plurality of positions.

* * * * *